US006261018B1

(12) United States Patent
Chen

(10) Patent No.: US 6,261,018 B1
(45) Date of Patent: Jul. 17, 2001

(54) WRITING INSTRUMENT WITH SOUND AND ILLUMINATION FUNCTIONS

(75) Inventor: Chen-Yi Chen, Hsi Chih (TW)

(73) Assignee: Taiwan Stamp Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/648,059

(22) Filed: Aug. 25, 2000

(51) Int. Cl.[7] ..... B43K 29/00
(52) U.S. Cl. ..... 401/195; 362/118
(58) Field of Search ..... 401/195, 52, 192, 401/194; 362/118, 109, 119

(56) References Cited

U.S. PATENT DOCUMENTS 5,544,967 * 8/1996 Yao ..... 401/195
5,967,686 * 10/1999 Melnick ..... 401/195
6,129,473 * 10/2000 Shu ..... 401/195

* cited by examiner

*Primary Examiner*—David J. Walczak
(74) *Attorney, Agent, or Firm*—Rosenberg, Klein & Lee

(57) ABSTRACT

A writing instrument with sound and illumination functions has a case with an ink cartridge. A chamber is mounted on the case. A buzzer and an IC board are installed in the chamber. The IC board has an LED mounted on the upper surface and two battery seats with a battery in each seat mounted on the bottom surface. When writing, the circuit consisting of the buzzer, the LED, the IC board and the batteries is completed so that the LED emits light and the buzzer makes a sound or plays music.

3 Claims, 5 Drawing Sheets

WRITING INSTRUMENT WITH SOUND AND ILLUMINATION FUNCTIONS

BACKGROUND OF THE INVENTION

1. Field of the Invention

The present invention is related to a writing instrument, and more particularly to an interesting pen that can make sounds and emit light.

2. Description of Related Art

A writing instrument is a necessary tool for a person. However, conventional writing instruments are not attractive to children because of their monotonous appearances. Thus, a writing instrument with an illumination function was invented for children, and the children welcomed it with much interest. Nevertheless, the writing instrument with only an illumination function will soon lose its appeal to children.

Therefore, an objective of the present invention is to provide a writing instrument not only with an illumination function but also a sound function to mitigate and/or obviate the aforementioned problems.

SUMMARY OF THE INVENTION

The main objective of the invention is to provide a writing instrument that can emit light and sound.

Another objective of the invention is to provide a writing instrument in which the sound function can be enabled or disabled by the user.

Other objects, advantages and novel features of the invention will become more apparent from the following detailed description when taken in conjunction with the accompanying drawings.

DETAILED DESCRIPTION OF THE PREFERRED EMBODIMENT

Figure 1:
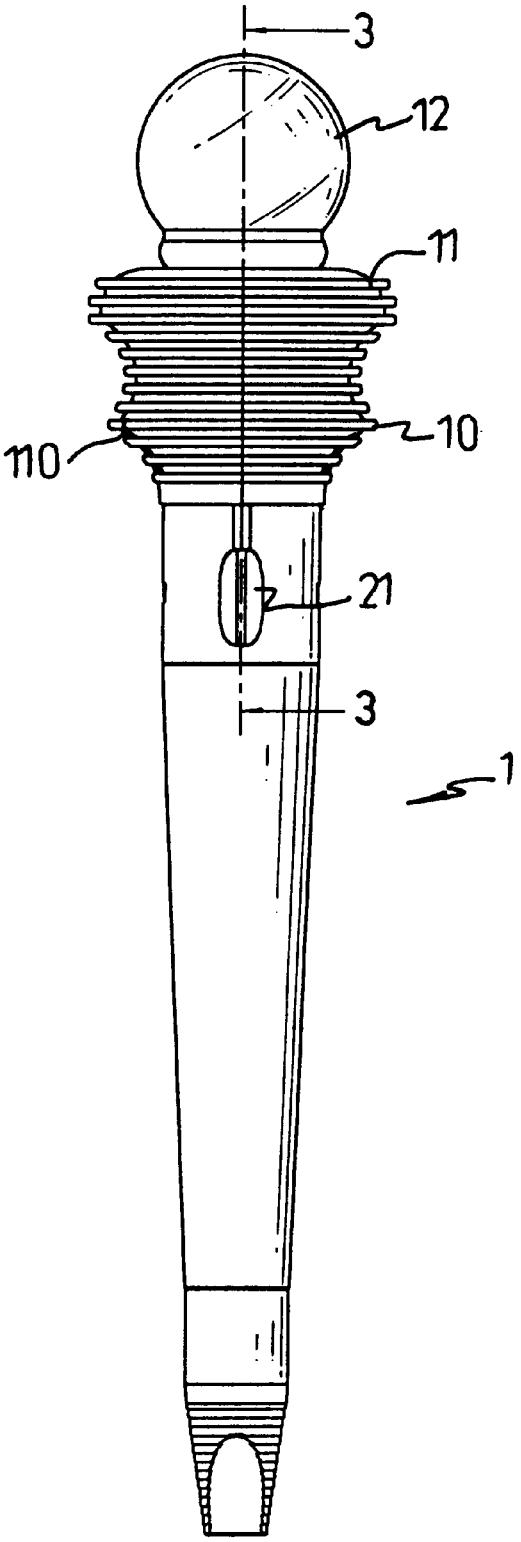
FIG. 1 is a perspective view of a pen in accordance with the present invention.
Figure 2:
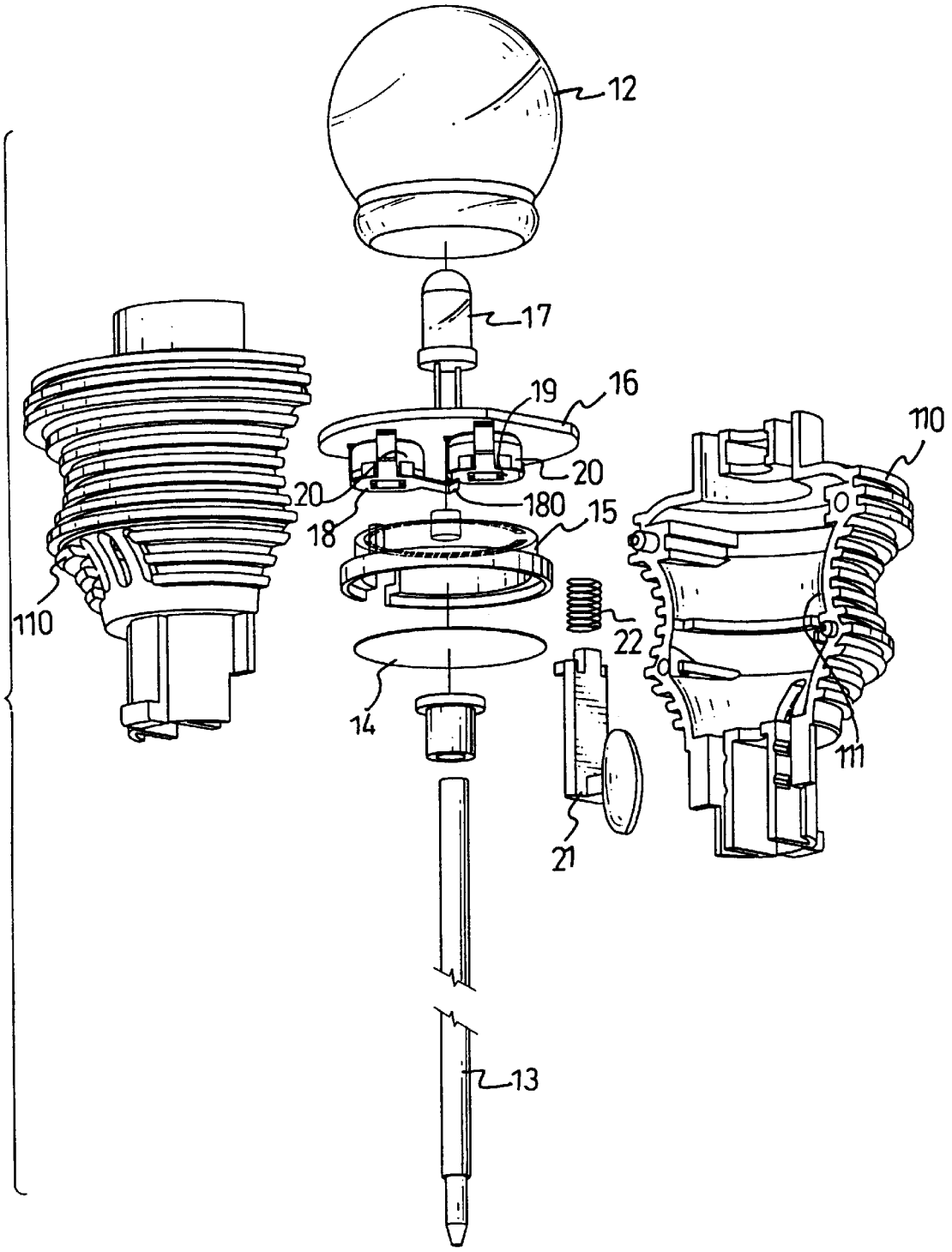
FIG. 2 is an exploded perspective view of the pen in FIG. 1.
Figure 3:
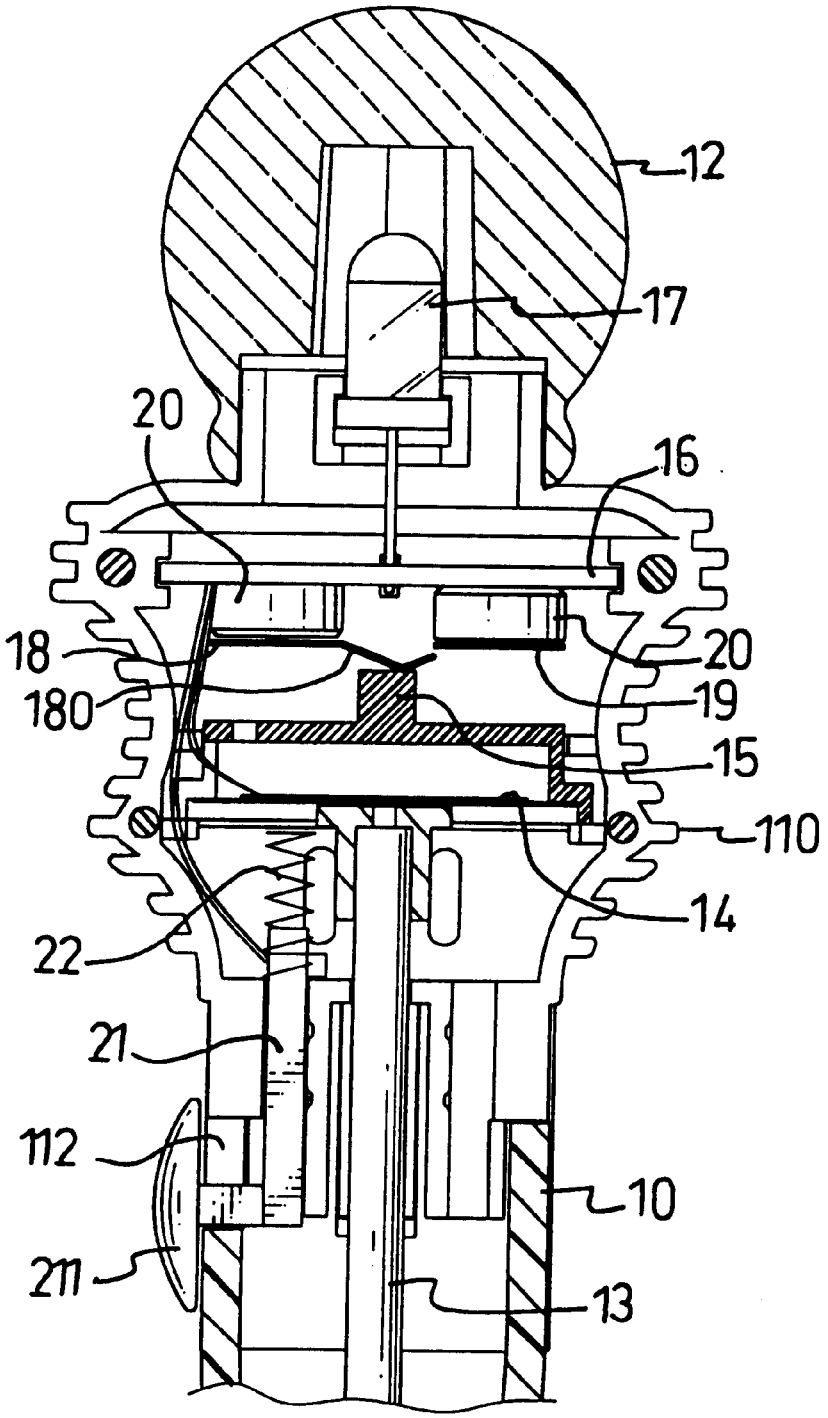
FIG. 3 is a cross sectional side plan view of the pen in FIG. 1 along lines "3—3" with the power off.
Figure 4:
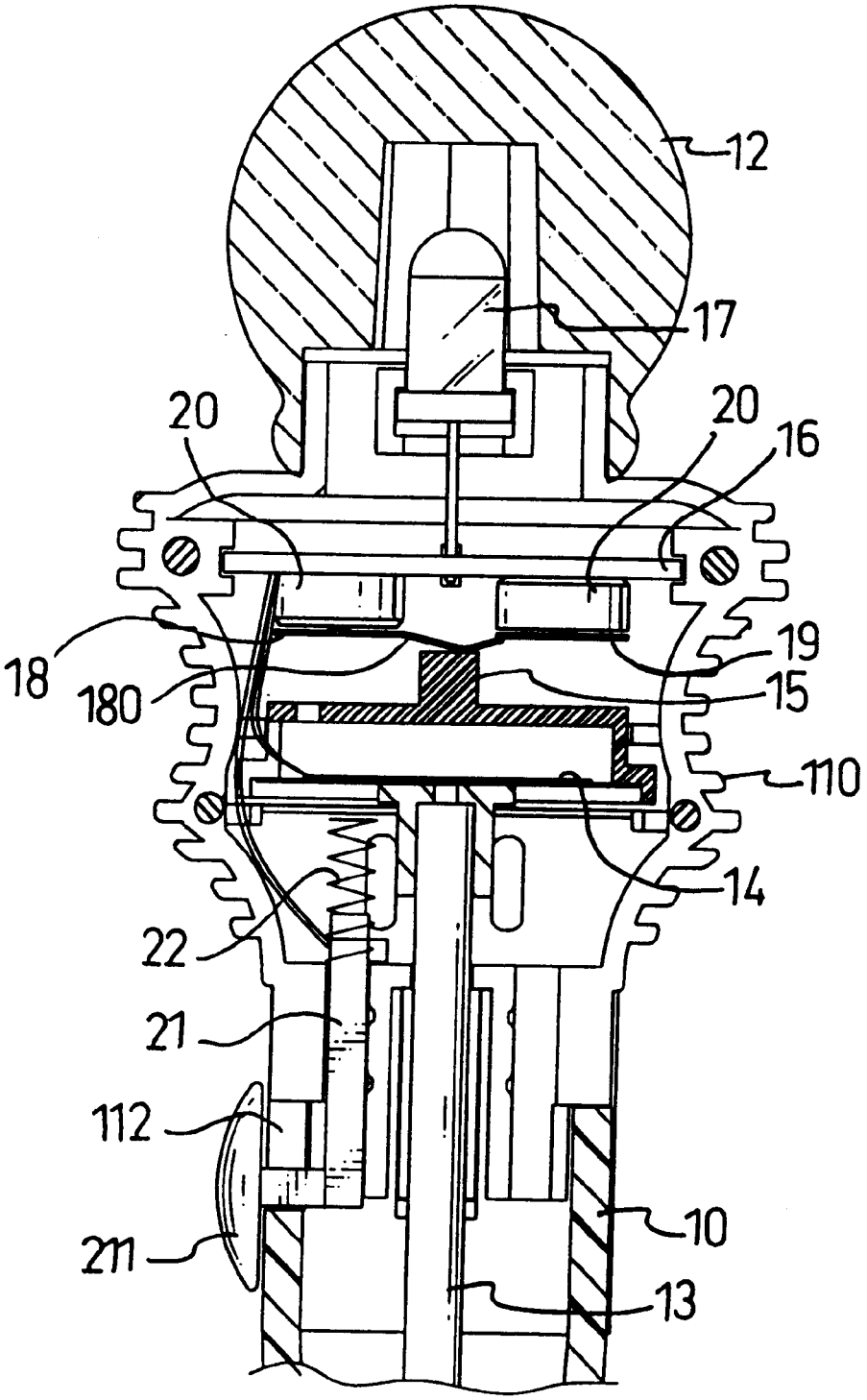
FIG. 4 is a cross sectional side plan view of the pen in FIG. 1 along the lines "3—3" with the power on to the lighting element but the power off to the sound element.

With reference to FIGS. 1 and 2, a writing instrument (1) in accordance with the invention comprises a case (10), a chamber (11) and a transparent decoration (12). The chamber (11) is provided at an upper end of the case (10) and is formed from two matched shells (110). The transparent decoration (12) is provided on a top end of the chamber (11).

With reference to FIGS. 1–4, an ink cartridge (13) is received in the case (10) and extends in the chamber (11). A buzzer (14) is provided at an upper end of the ink cartridge (13). A cap (15) is mounted on the buzzer (14) and an IC (Integrated Circuit) board (16) is provided on the cap (15). An LED (Light Emitting Diode) (17) is mounted on an upper surface of the IC board (16) and extends away from the chamber ( 11) into the transparent decoration (12). First and second battery seats (18, 19) are formed on a the bottom surface of the IC board (16), and each have a battery (20) installed. A resilient conducting lever (180) is integrally formed with the first seat (18) and extends towards the second seat (19) but does not make contact with the battery (20) in the second seat (19). The bottom face of the lever (180) rests on the top of the cap (15). A sliding switch (21) is mounted in a mated pair of recesses (111) in the shells (110). A button (211) formed on the switch (21) extends out of a hole (112) formed in the chamber (11) by the mating of the shells (110). An electrical contact (22) is mounted on an upper end of the switch (21) and below the buzzer (14). Although the electrical contact (22) can be any conductive member, such as a metal strip or a spring, it is a spring in this embodiment. The switch (21) is movable in a longitudinal direction and can connect the electrical contact (22) with the buzzer (14) when in the up position. In addition to being connected to the batteries (20), the leads of the LED (17) are electrically connected to the buzzer (14) and the electrical contact (22), respectively.

When the writing instrument is being used to write, the ink cartridge (13) pushes the cap (15) upwards as the end of the ink cartridge (13) is pressed against the paper to write. When the cap (15) is pushed up, the resilient conducting lever (180) is pressed against the second battery seat (19) causing the circuit through the LED (17) to be completed, and the LED (17) is lighted. In this case, the buzzer (14) does not sound because the electrical contact (22) is not connected with the buzzer (14).

Figure 5:
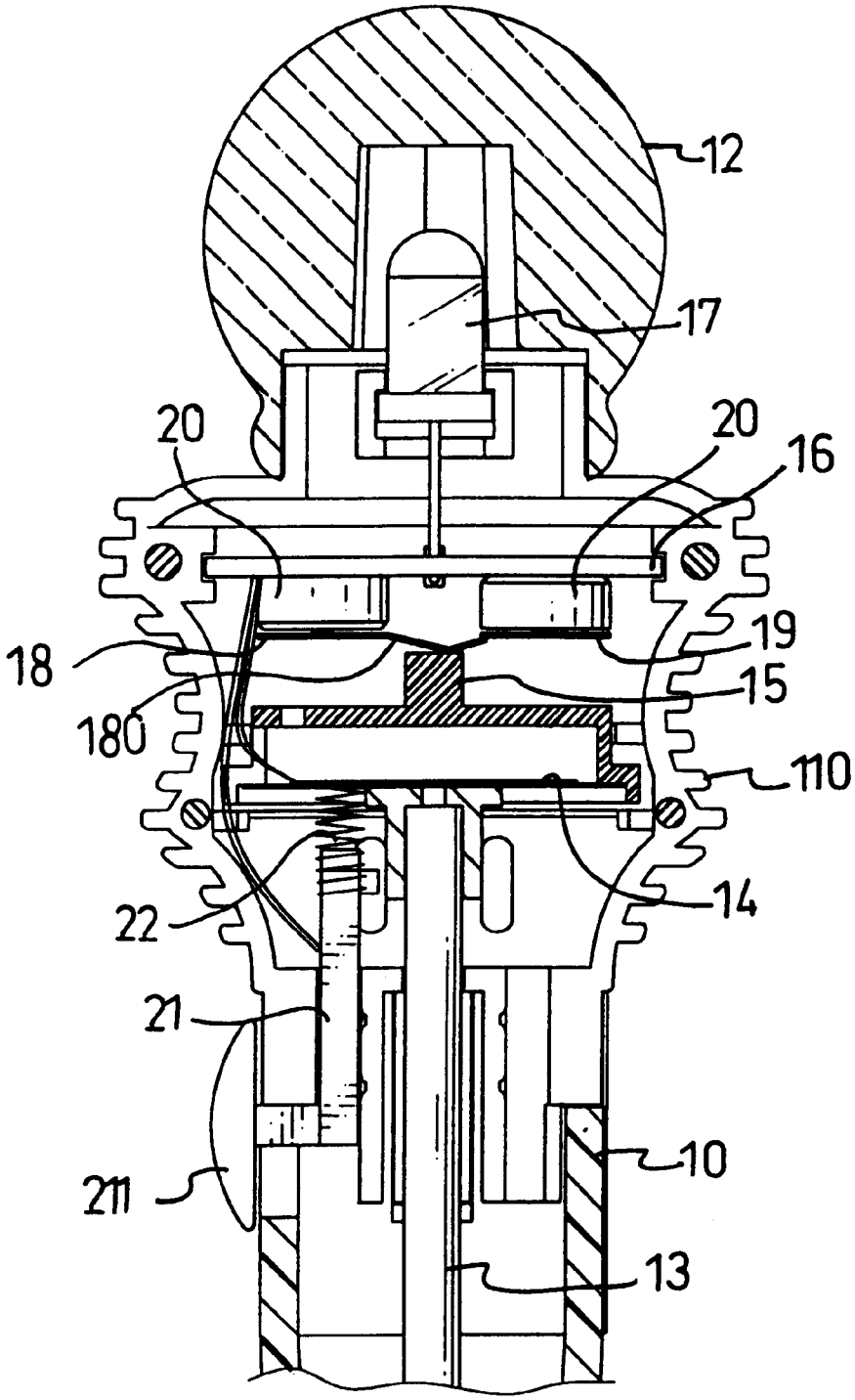
FIG. 5 is a cross sectional side plan view of the pen in FIG. 1 along the lines "3—3" with the power on to the light and sound elements.

With reference to FIG. 5, the switch (21) is pushed upwards to electrically connect the buzzer (14) with the LED (17) by the electrical contact (22). Therefore, when the circuit is closed by the cap (15) pressing against the conducting lever (180) when the writing instrument is being used to write, the LED comes on, and the buzzer (14) plays music. The user can disable the buzzer (14) with the switch (21) to keep from disturbing other people in special locations such as classrooms, libraries and so on.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An instrument for writing with sound and illumination functions, comprising:

a case (10) have an ink cartridge (13) having a top end and a bottom end, said ink cartridge being received inside said case;

a chamber (11) formed by two combined shells (110) and mounted on a top end of the case (10);

a decoration (12) formed on a top end of the chamber (11);

a buzzer (14) mounted in the chamber (11) at the top end of the ink cartridge (13);

a cap (15) mounted on the buzzer (14);

an IC board (16) mounted in the chamber (11) and having an LED (17) mounted on an upper surface of the IC board and extending away from the chamber (11) and into the decoration (12); first and second battery seats (18, 19) formed on a bottom surface of the IC board and each battery seat (18, 19) having a battery (20) installed in the seat (18, 19), and a resilient conducting lever (180) integrally formed on the first battery seat (18) and extending towards the second battery seat (19) but not electrically connecting with the battery (20) in the second battery seat (19), and the bottom of the resilient conducting level (180) resting on the cap (15), wherein leads of the LED (17) are electrically connected to the batteries (20), and further electrically connected to the buzzer (14);

whereby, when writing, the bottom end of the ink cartridge (13) presses against a sheet of paper causing the top end of the ink cartridge to press upwards against the cap (15) that presses against the resilient conducting lever (180) that makes an electrical connection with the battery (20) in the second seat (19), and the LED (17) and the buzzer (14) are switched on.

2. The instrument for writing as claimed in claim 1 further comprising a switch (21), which is movable in a longitudinal direction, having a button (211) formed on the switch extending out of a hole (112) formed in the chamber (11) by the mating of the shells (110), and an electrical contact (22) mounted on the upper end of the switch (21) and below the buzzer (14).

3. The instrument for writing as claimed in claim 2, wherein the electrical contact (22) is a spring.

* * * * *